United States Patent [19]

Luo et al.

[11] 4,273,039

[45] Jun. 16, 1981

[54] IMPACT PRINTING APPARATUS AND METHOD USING RELUCTANCE SWITCHING AND A CLOSED LOOP DRIVE SYSTEM

[75] Inventors: Zong S. Luo; Todd M. Woodcock, both of Boise, Id.

[73] Assignee: Hewlett Packard Company, Palo Alto, Calif.

[21] Appl. No.: 63,502

[22] Filed: Aug. 3, 1979

[51] Int. Cl.[3] ..... B41J 9/42; B41J 3/12

[52] U.S. Cl. ..... 101/93.02; 101/93.05; 400/124

[58] Field of Search ..... 400/124, 121, 157.2; 101/93.02, 93.04, 93.29, 93.48, 93.05; 335/229, 235; 361/152

[56] References Cited

U.S. PATENT DOCUMENTS

| | | | |
|---|---|---|---|
| 3,507,213 | 4/1970 | Derc | 101/93.02 |
| 3,707,122 | 12/1972 | Cargill | 101/93.34 |

OTHER PUBLICATIONS

IBM Tech. Disc. Bulletin, S. H. Mills et al., vol. 15, No. 8, Jan. 1973, p. 2356.

*Primary Examiner*—Paul T. Sewell

*Attorney, Agent, or Firm*—David A. Boone

[57] ABSTRACT

An electromagnet and a permanent magnet are arranged in parallel between first and second pole pieces having a metallic spring tine coupled to the first pole piece and disposed to be attracted to the second pole piece by the magnetic field of the permanent magnet. A sensing coil is positioned to sense magnetic flux changes resulting from changes in position of the metallic spring tine. In operation the spring tine is displaced to the second pole piece and captured at a home position by field energy from the permanent magnet. When there is a demand for printing, the electromagnet is energized in a first polarity such that its reluctance to the field of the permanent magnet is minimized and the flux from the permanent magnet is attracted to pass through the core of the electromagnet thereby nullifying the traction between the spring tine and the second pole piece and the spring tine is released. Potential energy stored in the tine by the displacement of the tine is transformed to kinetic energy and the tine moves swiftly to effect a print impact. Following impact, the electromagnet is energized in a second polarity such that its reluctance to the field of the permanent magnet is of the spring tine. Flux movements detected by the sensing coil are utilized in a closed loop system to regulate amplitude and polarity of the field of the electromagnet for home, release and capture cycles of the apparatus.

3 Claims, 7 Drawing Figures

IMPACT PRINTING APPARATUS AND METHOD USING RELUCTANCE SWITCHING AND A CLOSED LOOP DRIVE SYSTEM

BACKGROUND AND SUMMARY OF THE INVENTION

Impact printing apparatus have been designed which utilize electromagnets or a series combination of an electromagnet and a permanent magnet to move a print wire in an impact direction. Such prior apparatus are disclosed, for example, in U.S. Pat. Nos. 3,198,306; 3,209,681; 3,210,616; 3,217,640; 3,304,858; 3,584,575; 3,592,311; 3,672,482; 3,690,431; 3,729,079; 3,854,564 and French Pat. No. 1,364,529. Such devices have required relatively high power dissipation and are typically limited in speed and reliability due to attendant heat rise in operation. Devices employing series permanent magnets have experienced demagnetization of the permanent magnets. The invention provides lower power dissipation, higher speed and reliability and a capability of monitoring print cycles by utilizing an electromagnet and a permanent magnet arranged in a parallel circuit between first and second pole pieces having a metallic spring tine disposed to be attracted to the second pole piece by the magnetic field of the permanent magnet. A sensing coil is positioned to sense magnetic flux changes resulting from changes in position of the metallic spring tine. In operation the spring tine is displaced to the second pole piece and captured at a home position by field energy from the permanent magnet. When there is a demand for printing, the electromagnet is energized in a first polarity such that its reluctance to the field of the permanent magnet is minimized and the flux from the permanent magnet is attracted to pass through the core of the electromagnet thereby nullifying the traction between the spring tine and the second pole piece and the spring tine is released. Potential energy stored in the tine by the prior displacement of the tine is transformed to kinetic energy and the tine moves swiftly to effect a print impact. Following impact, the electromagnet is energized in a second polarity such that its reluctance to the field of the permanent magnet is increased. The magnetic flux from the permanent magnet is thereby directed out of the second pole piece to perform a recapture of the spring tine. Flux movements detected by the sensing coil are utilized in a closed loop system to regulate amplitude and polarity of the field of the electromagnet for home, release and capture cycles of the apparatus.

DESCRIPTION OF THE PREFERRED EMBODIMENT

Figure 1:
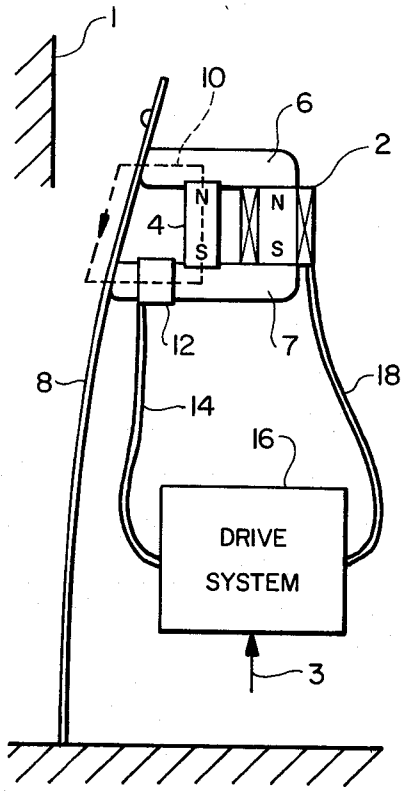
FIG. 1 is a drawing of a preferred impact printing apparatus in a home position illustrating flux paths and magnetic polarities.

Referring to FIG. 1, a preferred impact printing apparatus is shown in a home position with reference to a platen 1. An electromagnet 2 and a permanent magnet 4 are arranged in a parallel flux circuit about a first pole piece 6 and a second pole piece 7 having a metallic spring tine 8 disposed to be attracted to the pole piece 6 by magnetic flux 10 produced by a permanent magnet 4. A sensing coil 12 is positioned to sense magnetic flux changes resulting from changes in position of the metallic spring tine 8 and changes in polarity in electromagnet 2. In the home position shown, the sensing coil 12 produces a sense voltage output 14 which is relatively low in amplitude to a drive system 16 which produces in response thereto a drive current 18 which is of a first or positive polarity and of relatively low amplitude to produce the field polarity of electromagnet 2 shown and thereby increase the reluctance of electromagnet 2 to the flux of the permanent magnet 4. The flux from the permanent magnet 4 follows a flux path 10 indicated in FIG. 1 thereby retaining the spring tine 8 in the home position indicated.

Figure 2:
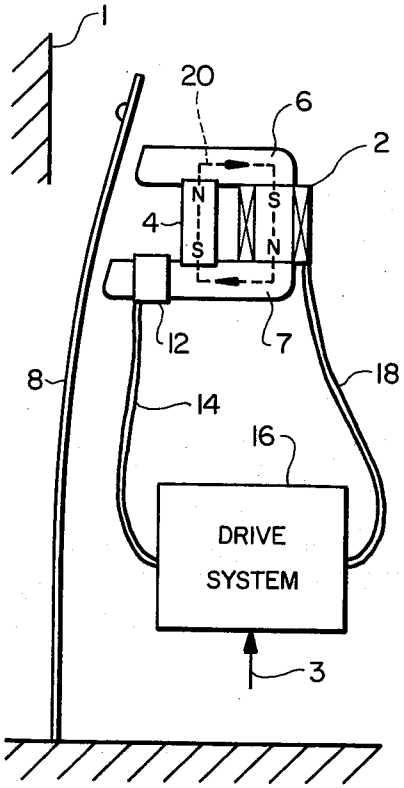
FIG. 2 is a drawing of a preferred impact printing apparatus in a release position illustrating flux paths and magnetic polarities.

Referring to FIG. 2, the drive system 16 receives a firing pulse 3 and the preferred impact printing apparatus is shown in a release position with reference to platen 1. The field polarity of the electromagnet 2 is reversed and increased to release the spring tine 8 by decreasing the reluctance of electromagnet 2 to the flux from the permanent magnet 4 thereby forcing a flux path 20 as shown. The sensing coil 12 produces a sense voltage output 14 which is essentially off and the drive system 16 produces a drive current 18 which is relatively low in amplitude and opposite in polarity to the sense current output required for the preferred impact printing apparatus to be in the home position previously discussed with reference to FIG. 1.

Figure 3:
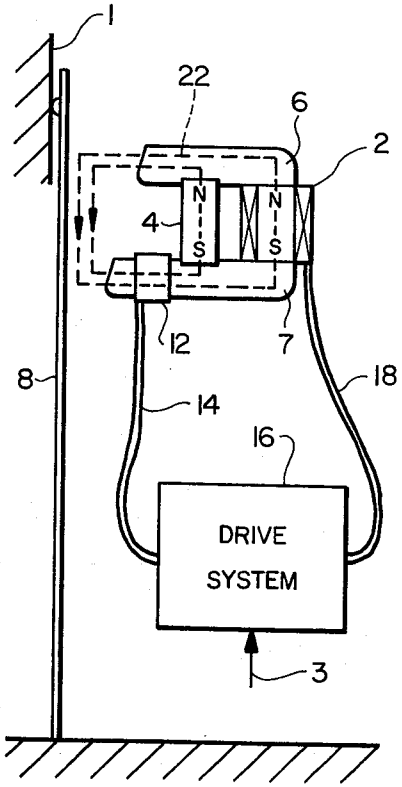
FIG. 3 is a drawing of a preferred impact printing apparatus in a capture position illustrating flux paths and magnetic polarities.

Referring to FIG. 3, the preferred impact printing apparatus is shown in a capture position with reference to a platen 1. After printing, the drive system 16 produces a drive current 18 which is relatively high in amplitude to produce a field from the electromagnet 2 which has a polarity as shown. A flux 22 is produced by the electromagnet 2 and the permanent magnet 4 in combination which captures the spring tine 8 and attracts it to the home position. The combined effects of the fields produced by the electromagnet 2 and permanent magnet 4 cause the sensing coil 12 to produce a relatively high output.

Figure 4:
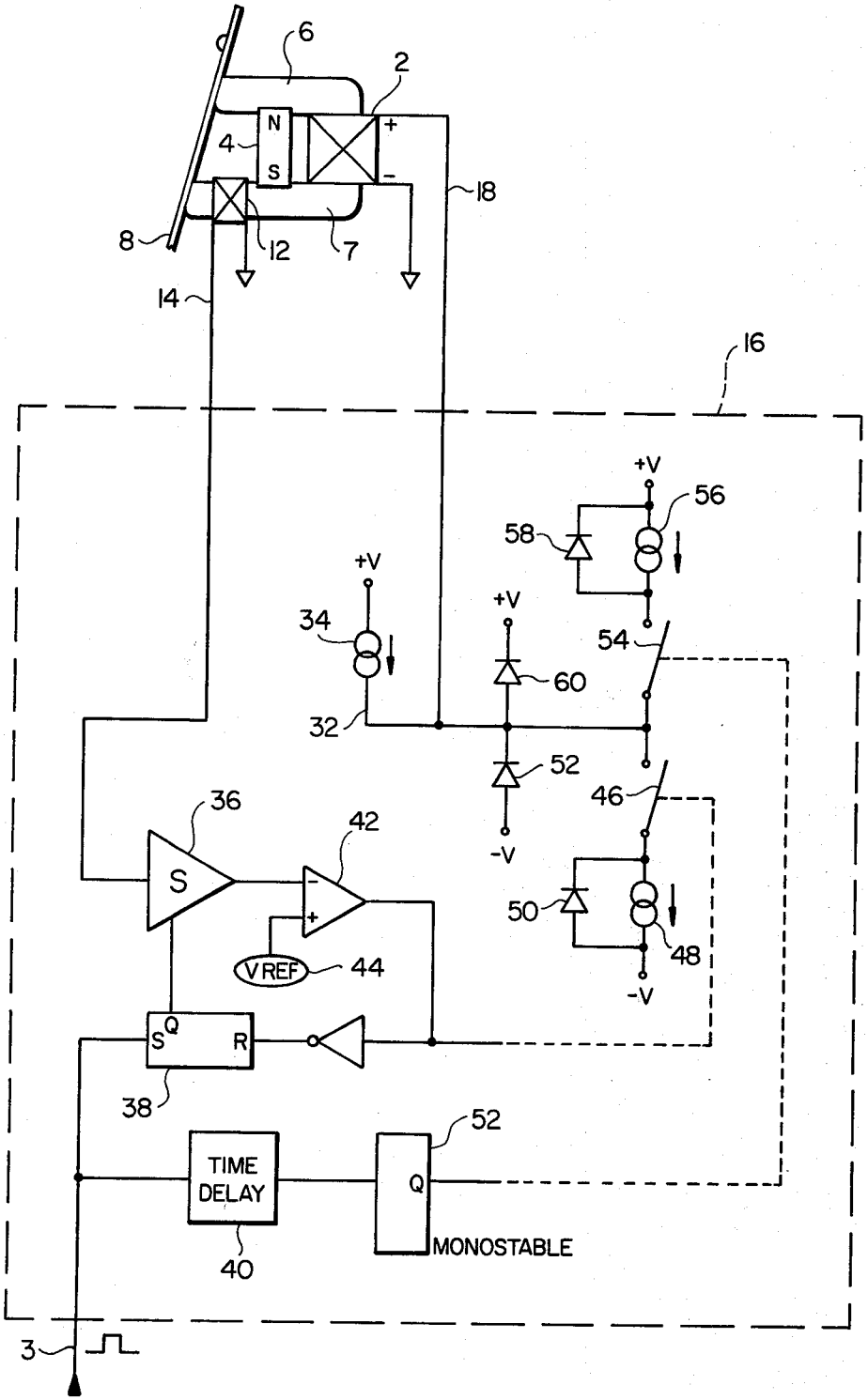
FIG. 4 is a schematic diagram of a preferred drive system.
Figure 5:
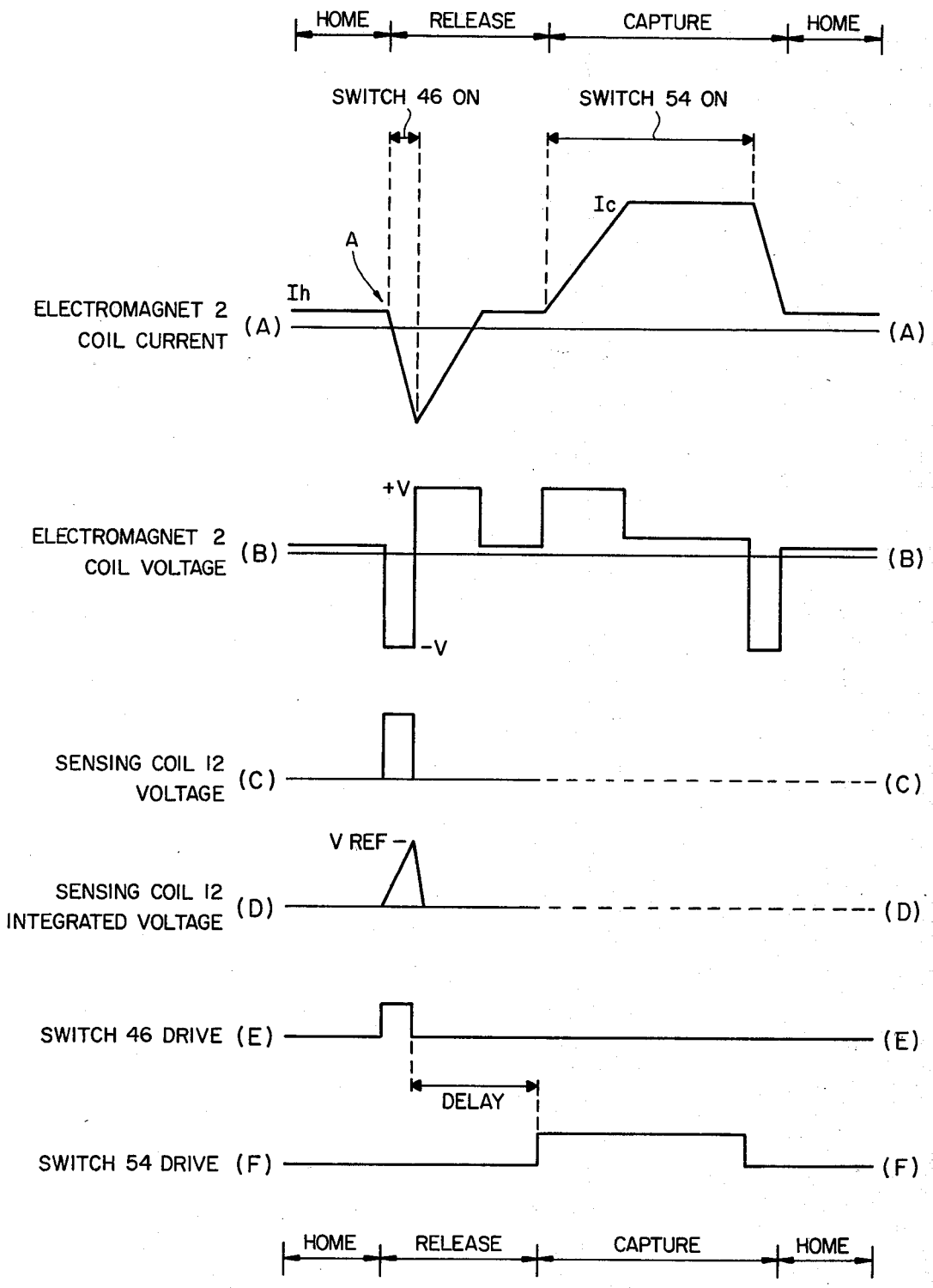
FIG. 5 is a drawing illustrating typical waveforms for the drive system diagrammed in FIG. 4.

Referring to FIG. 4, a detailed block diagram of the drive system 16 is shown. Current and voltage waveforms for the drive system 16 are shown in FIG. 5. Assume the metallic spring tine 8 is in the home position and a holding current 32 is produced by a current source 34 shown in FIG. 4. The corresponding current through electromagnet 2 is shown in waveform (a) of FIG. 5. The sensing coil 12 produces a sensing current 14 output which produces a negligibly low amplitude to an integrator 36 as shown by waveform C of FIG. 5.

Assume that the firing pulse 3 is applied at point A shown in waveform (a) of FIG. 5. A flip flop 38 is set and a time delay 40 begins timing. The flip flop 38 has its Q output coupled to the integrator 36 which causes the integrator 36 to begin integrating the sensing coil voltage from the sensing coil 12. The output from the integrator 36 is applied to a voltage comparator 42 which compares the integrated sensing coil voltage with a voltage reference 44. The output of the voltage comparator is applied to a switch 46 which couples a release current generator 48 to the electromagnet 2. A diode 50 is coupled across the release current generator 48 to provide a current path when the switch 46 is in the off position. Electromagnet 2 coil current is illustrated in waveform (a) of FIG. 5. Diode 52 is coupled to switch 46 to provide for fly back current when the switch 46 is reopened. Referring to the voltage comparator 42, the reference voltage 44 is set such that the flux through the sensing coil 12 is zero when the integral of the sensing coil voltage is equal to the voltage reference 44, shown as $V_{REF}$ in waveform (d) of FIG. 5. When the zero flux point is reached, that is the integrated sensing coil 12 voltage as shown in waveform (d) of FIG. 5, is equal to the value of the voltage of voltage reference 44, the flip flop 38 is reset thereby setting and holding the integrator 36 at a zero output until it receives a next firing pulse 3.

When the integrator 36 is reset to zero by the flip flop 38, the switch 46 reopens as shown in waveform (e) of FIG. 5. Referring to the time delay 40 and waveform (f) of FIG. 5, at the end of a selected time delay, the time delay 40 applies a signal to a monostable multivibrator 52 which closes a switch 54 to apply a capture current generator 56 to the electromagnet 2. The capture current generator 56 includes a diode 58 which provides for a current path for the capture current generator 56 when switch 54 is reopened. A diode 60 is coupled to the switch 54 to provide a path for flyback current when switch 54 is turned off. The effect of the capture current generator 56 is illustrated in waveform (a) of FIG. 5. The values +V and −V of the voltage sources are selected to obtain a desired current rise time in the electromagnet coil 2. Maximum current values are limited by the current values of the capture current source 56 and the release current source 48.

Figure 6B:
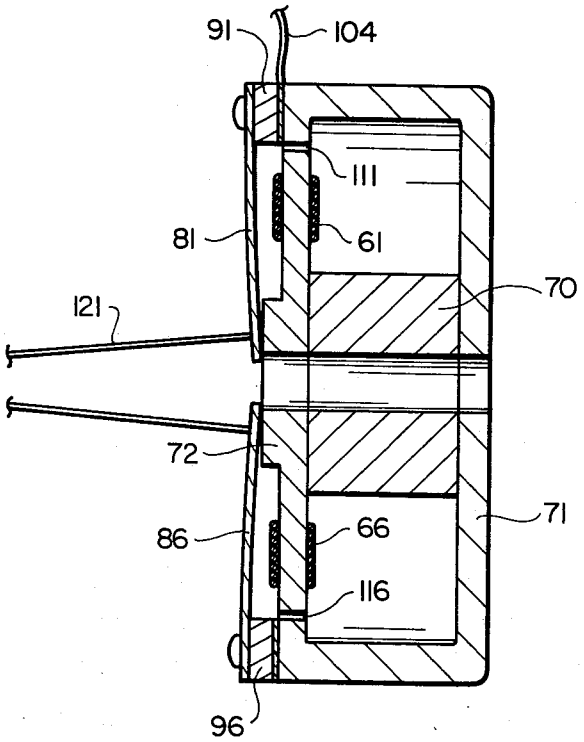
FIGS. 6A and 6B are drawings illustrating a preferred dot matrix printhead.
Figure 6A:
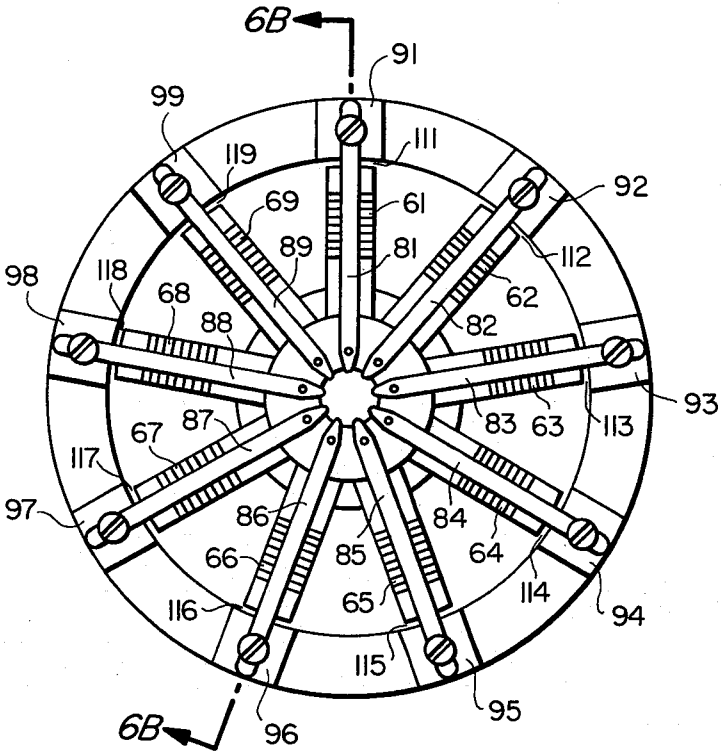

Referring to FIG. 6, a preferred embodiment of the invention is shown in the form of a dot matrix print head. Electromagnets 61, 62, 63, 64, 65, 66, 67, 68 and 69 are arranged in a parallel magnetic flux circuit with a permanent ring magnet 70 coupled to a pole piece 71 and a pole piece 72. Spring tines 81, 82, 83, 84, 85, 86, 87, 88 and 89 are disposed to be attracted to the pole piece 72 by magnetic flux produced by the permanent ring magnet 70. Sensing coils 91, 92, 93, 94, 95, 96, 97, 98 and 99 are positioned to sense magnetic flux changes resulting from changes in position of the metallic spring tines 81, 82, 83, 84, 85, 86, 87, 88 and 89. In operation of the spring tine 81 for example, the sensing coil 91 produces a sense current output 104 similar to the sense current output 14 described hereinbefore with reference to FIGS. 1, 2, 3 and as shown in FIG. 5. The output 104 is applied to a drive system similar to that shown in FIG. 4. Reluctance gaps 111, 112, 113, 114, 115, 116, 117, 118 and 119 are implemented to effectively channel flux from the permanent ring magnet 70 in both homing and capturing the spring tines 81 through 89.

In operation of the spring tine 81 for example, the spring tine 81 is captured at the home position shown by field energy from the permanent magnet 70. The reluctance gap 111 effectively channels substantially all magnetic flux from magnet 70 through the tine 81 at its homing state. When there is a demand for printing, the electromagnet 61 is energized such that its reluctance to the field of magnet 70 is minimized and the flux from the permanent magnet 70 is attracted to pass through the core of the electromagnet 61 thereby releasing the traction between the tine 81 and the pole piece 72. The potential energy stored in the tine 81 by its original displacement to the home position is transformed to kinetic energy and the tine 81 moves forward swiftly thereby causing a print wire 121 to effect a print impact. Following completion of the print impact, the electromagnet 61 is energized in a reverse polarity thereby switching its reluctance to an increased value to the magnet field of the permanent magnet 70. The combined magnetic fields from the electromagnet 61 and the permanent magnet 70 are directed out of the pole piece 72 to capture the spring tine 81 and return it to the home position. The tine 81 is held at the home position after completion of each release and capture cycle.

The preferred embodiment includes a plurality of print wires corresponding to the print wire 121, one print wire being associated with each of the spring tines 81, 82, 83, 84, 85, 86, 87, 88 and 89. The plurality of print wires are directed to form a series of linearly aligned points adjacent a platen and the spring tines are selectively actuated to print a dot matrix scan corresponding to a desired character, number, symbol or graphics portion.

We claim:

1. Printing apparatus comprising:

a first pole piece;

a second pole piece;

magnetic field means magnetically coupled to the first pole piece and the second pole piece for producing a first magnetic field;

reluctance switching means having reluctance and being magnetically coupled to the first pole piece and the second pole piece for varying reluctance in response to receiving a switching signal;

a ferromagnetic tine disposed to be attracted to the second pole piece by the first magnetic field, said ferromagnetic tine being magnetically coupled to the first pole piece and being structurally connected to the first pole piece and structurally distortable by the first magnetic field; said reluctance switching means comprising an electromagnet coupled to the first pole piece and the second pole piece;

sensing means for detecting changes in magnetic flux resulting from changes in position of the ferromagnetic tine and producing a sensing signal; and driving means coupled to receive the sensing signal and an applied firing signal for first applying a signal of a first polarity to the electromagnet in response to the firing signal and then applying a signal of a second polarity to the electromagnet in response to the sensing signal.

2. Printing apparatus as in claim 1 wherein sensing means comprise a coil disposed to detect magnetic flux changes in the first pole piece and the second pole piece.

3. Printing apparatus as in claim 1 wherein driving means comprise:

a first flip flop having a Q output, a reset input and a set input coupled to receive the applied firing signal;

an integrator coupled to receive the sensing signal and having an output and having a zero input coupled to the first flip flop Q output;

a voltage comparator having an output and having a first input coupled to receive the integrator output and having a second input coupled to a first voltage reference;

a first current source;

a first switch coupled to receive the voltage comparator output for coupling the first current source to the electromagnet in response to the integrator output;

a second current source;

a second switch coupled to receive a recapture signal for coupling the second current source to the electromagnet in response to receiving the recapture signal; and a time delay coupled to the second switch and to receive the applied firing signal for applying the recapture signal to the second switch after a selected time delay.

* * * * *

UNITED STATES PATENT AND TRADEMARK OFFICE

CERTIFICATE OF CORRECTION

PATENT NO. : 4,273,039

DATED : June 16, 1981

INVENTOR(S) : Zong S. Luo; Todd M. Woodcock

It is certified that error appears in the above-identified patent and that said Letters Patent are hereby corrected as shown below:

In the Abstract, line 22, delete "of the spring tine." and insert --increased.--

Signed and Sealed this

*Seventeenth* Day of *November 1981*

[SEAL]

*Attest:*

GERALD J. MOSSINGHOFF

*Attesting Officer*

*Commissioner of Patents and Trademarks*